US010768646B2

(12) United States Patent
Yang

(10) Patent No.: US 10,768,646 B2
(45) Date of Patent: Sep. 8, 2020

(54) LOW DROPOUT REGULATING DEVICE AND OPERATING METHOD THEREOF

(71) Applicant: MACRONIX INTERNATIONAL CO., LTD., Hsinchu (TW)

(72) Inventor: Yih-Shan Yang, Hsinchu (TW)

(73) Assignee: MACRONIX INTERNATIONAL CO., LTD., Hsinchu (TW)

( * ) Notice: Subject to any disclaimer, the term of this patent is extended or adjusted under 35 U.S.C. 154(b) by 555 days.

(21) Appl. No.: 15/454,056

(22) Filed: Mar. 9, 2017

(65) Prior Publication Data

US 2018/0259987 A1 Sep. 13, 2018

(51) Int. Cl.
*G05F 1/46* (2006.01)
*G05F 1/575* (2006.01)

(52) U.S. Cl.
CPC ..... *G05F 1/468* (2013.01); *G05F 1/575* (2013.01)

(58) Field of Classification Search
CPC ..... G05F 1/00
USPC ..... 307/52
See application file for complete search history.

(56) References Cited

U.S. PATENT DOCUMENTS 6,023,156 A 2/2000 Buhler
8,773,095 B2 7/2014 Gakhar et al.
8,981,750 B1 3/2015 Meher et al.
2007/0139025 A1* 6/2007 Vinn ..... H02M 3/156 323/273
2010/0102793 A1* 4/2010 Dishman ..... G06F 1/26 323/305
2011/0181258 A1* 7/2011 Ivanov ..... G05F 1/575 323/282
2014/0210430 A1* 7/2014 Bhattad ..... G05F 1/575 323/233
2014/0225580 A1* 8/2014 Carbonini ..... G05F 1/575 323/280
2014/0266099 A1* 9/2014 Ku ..... G05F 1/56 323/273

FOREIGN PATENT DOCUMENTS

CN 1609743 A 4/2005
CN 105474118 A 4/2016

OTHER PUBLICATIONS

TIPO Office Action dated Dec. 1, 2017 in Taiwan application (No. 106105340).
CN Office Action dated Sep. 24, 2019 in Chinese application (No. 201710089773.5).

* cited by examiner

*Primary Examiner* — Rexford N Barnie
*Assistant Examiner* — Joseph N Inge
(74) *Attorney, Agent, or Firm* — McClure, Qualey & Rodack, LLP

(57) ABSTRACT

A low dropout (LDO) regulating device includes a regulator and a pre-charger. The regulator is configured to adjust an output voltage provided to an output node in accordance with a voltage difference between a first reference voltage and a feedback voltage on a feedback node, wherein the feedback node is coupled to the output node. The pre-charger is electrically connected to the regulator, and is electrically connected to the feedback node for charge sharing.

18 Claims, 11 Drawing Sheets

LOW DROPOUT REGULATING DEVICE AND OPERATING METHOD THEREOF

TECHNICAL FIELD

The present disclosure is directed to a low dropout (LDO) regulating device and an operating method thereof.

BACKGROUND

Low dropout (LDO) regulating devices have been widely used in various electronic products because of their advantages of low noise and low cost. The LDO regulating device can be used as a power supply circuit for providing a stable output voltage. For example, the LDO regulating device may provide DC power to a memory chip for operation.

However, an unstable, unpredictable output voltage may be generated during the transition between different operation states of the LDO regulating device, such that the load circuit fails to function properly. Therefore, there is a need to provide an improved LDO regulating device and an operating method thereof, to address the abovementioned issues.

SUMMARY

The present invention relates to a low dropout (LDO) regulating device and an operating method thereof, which is capable of accelerating the startup speed of the LDO regulating device, such that the time which the LDO regulating device is required to entering the normal operation can be shortened.

According to an embodiment of the present invention, a LDO regulating device is provided. The LDO regulating device includes a regulator and a pre-charger. The regulator is configured to adjust an output voltage provided to an output node in accordance with a voltage difference between a first reference voltage and a feedback voltage on a feedback node, wherein the feedback node is coupled to the output node, and the regulator includes a comparing circuit and an output transistor. The comparing circuit is configured to receive the first reference voltage and the feedback voltage, and generate a control voltage on a control node in accordance with the voltage difference between the first reference voltage and the feedback voltage. The output transistor includes a control terminal coupling to the control node a first terminal coupling to a supply voltage and a second terminal coupling to the output node, wherein the output transistor responds to the control voltage to generate the output voltage at the second terminal. The pre-charger is electrically connected to the regulator, the pre-charger being electrically connected to the feedback node for charge sharing.

According to another embodiment of the present invention, an operating method of a LDO regulating device is provided. The operating method includes steps of: configuring a regulator to adjust an output voltage provided to an output node in accordance with a voltage difference between a first reference voltage and a feedback voltage on a feedback node; configuring a pre-charger to electrically disconnect from the feedback node to accumulate charges in an OFF state of the regulator; and electrically connecting the pre-charger to the feedback node for charge sharing.

Figure 1A:
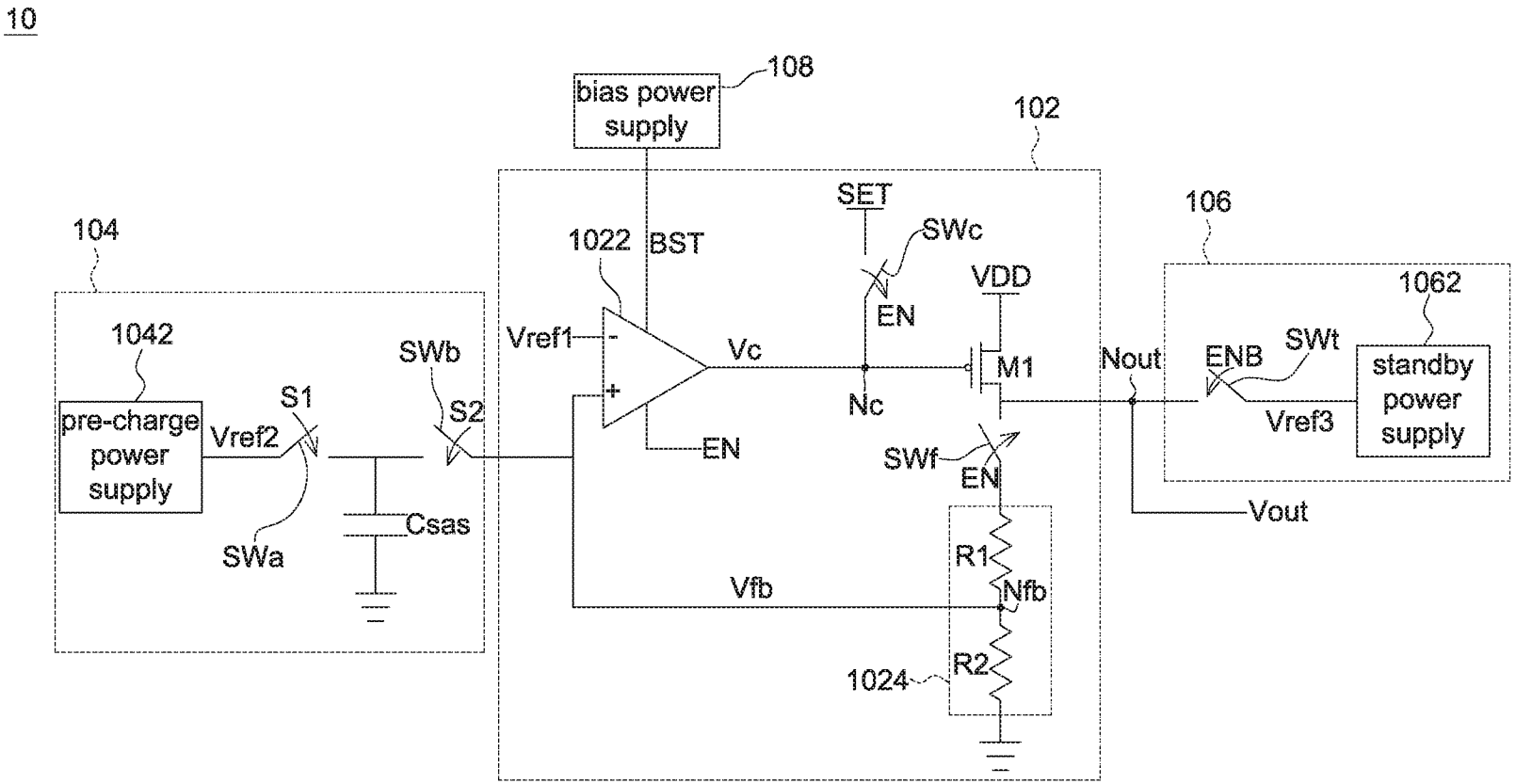
FIG. 1A illustrates a circuit diagram of a LDO regulating device according to an embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

A number of embodiments are disclosed below for elaborating the invention. However, the embodiments of the invention are for detailed descriptions only, not for limiting the scope of protection of the invention. Furthermore, secondary or unimportant elements are omitted in the accompanying diagrams of the embodiments for highlighting the technical features of the invention.

FIG. 1A illustrates a circuit diagram of a LDO regulating device 10 according to an embodiment of the present disclosure. The LDO regulating device 10 can be used to provide a regulated output voltage Vout to an output node Nout, such as a NOR flash memory, a NAND flash memory, a dynamic random-access memory (DRAM), or a static random-access memory (SRAM).

The LDO regulating device 10 includes a regulator 102 and a pre-charger 104, and optionally a maintain circuit 106 and a bias power supply 108.

The regulator 102 is to adjust an output voltage Vout provided to an output node Nout in accordance with a voltage difference between a first reference voltage Vref1 and a feedback voltage Vfb.

The regulator 102 includes a comparing circuit 1022, an output transistor M1 and a feedback circuit 1024. In this embodiment, the output transistor M1 is implemented as a P-type transistor, such as a PMOS.

The comparing circuit 1022 can be an operational amplifier (OPA) for example. The comparing circuit 1022 may receive the first reference voltage Vref1 and the feedback voltage Vfb, and generate a control voltage Vc on a control node Nc in accordance with the voltage difference between the first reference voltage Vref1 and the feedback voltage Vfb.

The output transistor M1 can be turned on in response to the control voltage Vc, and provides the output voltage Vout to the output node Nout accordingly. As shown in FIG. 1A, the output transistor M1 includes a control terminal (e.g., gate terminal) coupling to the control node Nc, a first terminal (e.g., source/drain terminal) coupling to a supply voltage VDD and a second terminal (e.g., drain/source terminal) coupling to the output node Nout. When the output transistor M1 is turned on, the supply voltage VDD is transferred to the output node Nout and taken as the output voltage Vout.

The feedback circuit 1024 couples between the output node Nout and the comparing circuit 1022, configures to provide a voltage division path to form the feedback node Nfb, and to provide the feedback voltage Vfb on the feedback node Nfb to the comparing circuit 1022.

As shown in FIG. 1A, the feedback circuit 1024 including a first impedance component R1 and a second impedance component R2 forms a voltage division path for the output voltage Vout. The first impedance component R1 is connected to the second impedance component R2 in series, and the interconnection between them forms the feedback node Nfb. The first impedance component R1 and the second impedance component R2 can be implemented as registers or any other circuit components equivalent to registers.

During the period of time that the LDO regulating device 10 works, if the output voltage Vout varies, the feedback voltage Vfb also changes. In such situation, the comparing circuit 1022 may respond to the variation of the feedback voltage Vfb to adjust the control voltage Vc of the comparing circuit 1022, so that the current outputted from the output transistor M1 is changed by the adjusted control voltage Vc, thereby keeping the output voltage Vout at a certain level.

The regulator 102 can be turned on or turned off by a switching signal EN. When the switching signal EN is enabled, the regulator 102 is in the ON state, and when the switching signal EN is disabled, the regulator 102 is in the OFF state. As shown in FIG. 1A, the comparing circuit 1022 can be turned on or turned off by the switching signal EN.

The regulator 102 may further include a control switch SWc. The control switch SWc couples between a setting voltage SET (e.g., supply voltage VDD) and the control node Nc, with a control terminal controlled by the switching signal EN. When the regulator 102 is in the ON state, the switching signal EN is enabled, and the control switch SWc is turned off, causing the setting voltage SET (which can be a supply voltage) to be electrically disconnected from the control node Nc. When the regulator 102 is in the OFF state, the switching signal EN is disabled, and the control switch SWc is turned on, causing the setting voltage SET to be passed to the control node Nc to turn off the output transistor M1.

In an embodiment, the regulator 102 further includes a feedback switch SWf controlled by the switching signal EN. The feedback switch SWf is disposed between the feedback circuit 1024 and the output node Nout. When the switching signal EN is enabled, the regulator 102 is in the ON state, the feedback switch SWf will be turned on to couple the output node Nout to the feedback circuit 1024. Conversely, when the switching signal EN is disabled, i.e., the regulator 102 is in the OFF state, the feedback switch SWf will be turned off to electrically disconnect the output node Nout from the feedback circuit 1024.

In an embodiment, the pre-charger 104 may per-charge the feedback voltage Vfb on the feedback node Nfb to a certain level.

The pre-charger 104 may electrically disconnect from the feedback node Nfb to accumulate charges when the regulator 102 is in the OFF state, and may temporarily electrically connect to the feedback node Nfb for charge sharing when the regulator 102 is in the ON state.

Generally, if without the pre-charger 104, as the regulator 102 switches from the OFF state to the ON state, the feedback voltage Vfb on the feedback node Nfb often takes a certain period of time to reach a voltage level suitable for executing voltage regulation operations. However, such period of time may significantly affect the "startup speed" of the LDO regulating device 10. To accelerate the startup speed of the LDO regulating device 10, the pre-charger 104 may share the charges accumulated thereon with the feedback node Nfb as the regulator 102 enters the ON state, so as to rapidly raise the level of the feedback voltage Vfb.

In an embodiment, the pre-charger 104 includes a pre-charge power supply 1042, a pre-charge capacitor Csas, a sampling switch SWa and a sharing switch SWb, which forms a charge sharing circuit configuration. The pre-charge power supply 1042 is to provide a second reference voltage Vref2. The sampling switch SWa couples between the pre-charge capacitor Csas and the pre-charge power supply 1042, allowing the pre-charge power supply 1042 to charge the pre-charge capacitor Csas. The sharing switch SWb couples between the pre-charge capacitor Csas and the feedback node Nfb, allowing the pre-charge capacitor Csas to share charges with the feedback node Nfb.

For example, when the regulator 102 is in the OFF state, the sampling switch SWa is turned on to couple the pre-charge capacitor Csas to the pre-charge power supply 1042, and the sharing switch SWb is turned off to electrically disconnect the pre-charge capacitor Csas from the feedback node Nfb. At this time, the pre-charge power supply 1042 charges the pre-charge capacitor Csas with the second reference voltage Vref2.

As the regulator 102 switches to the ON state, the sampling switch SWa may electrically disconnect the pre-charge capacitor Csas from the pre-charge power supply 1042 in a first period of time, and the sharing switch SWb may electrically connect the pre-charge capacitor Csas to the feedback node Nfb in a second period of time within the first period of time. In such situation, the accumulated charges on the pre-charge capacitor Csas will be shared to the parasitic capacitor on the feedback node Nfb, such that the feedback voltage Vfb rises rapidly. Because the capacitance of the parasitic capacitor on the feedback node Nfb is usually much smaller than that of the pre-charge capacitor Csas, a predetermined value of the feedback voltage Vfb after charge sharing can be determined by a properly designed pre-charge capacitor Csas, wherein the predetermined value is between a minimum voltage level of the feedback voltage Vfb and a stable state voltage level of the feedback voltage Vfb.

In an embodiment, the LDO regulating device 10 further includes a maintain circuit 106. The maintain circuit 106 may power the output node Nout when the regulator 102 is in the OFF state.

For example, the maintain circuit 106 includes a standby power supply 1062 and a standby switch SWt. The standby power supply 1062 can be implemented by another LDO regulating device, and is to provide a third reference voltage Vref3. The standby switch SWt is disposed between the standby power supply 1062 and the output node Nout, and is controlled by an inversed switching signal ENB. The standby switch SWt may allow the standby power supply 1062 to power the output node Nout with the third reference voltage Vref3 as the regulator 102 is in the OFF state.

For example, when the regulator 102 is in the ON state, the standby switch SWt is turned off to electrically disconnect the output power Nout from the standby power supply 1062. Conversely, when the regulator 102 is in the OFF state, the standby switch SWt is turned on to couple the output power Nout to the standby power supply 1062, such that the output power Nout can be powered by the standby power supply 1062.

With the maintain circuit 106, the output voltage Vout on the output node Nout can be kept at a certain level during the OFF state of the regulator 102, so the startup time required for the LDO regulating device 10 can be further shortened.

In an embodiment, both the pre-charge power supply 1042 of the pre-charger 104 and the standby power supply 1062 of the maintain circuit 106 can be integrated together. In such situation, the second reference voltage Vref2 is the same as the third reference voltage Vref3.

The LDO regulating device 10 may further include a bias power supply 108 coupled to the comparing circuit 1022. The bias power supply 108 can be implemented by a current mirror circuit and/or registers for example. When the regulator 102 is in the ON state, the bias power supply 108 may provide a bias signal BST to the comparing circuit 1022 to increase the bias current of the comparing circuit 1022, so as to accelerate the startup speed of the control node Nc.

Figure 1B:
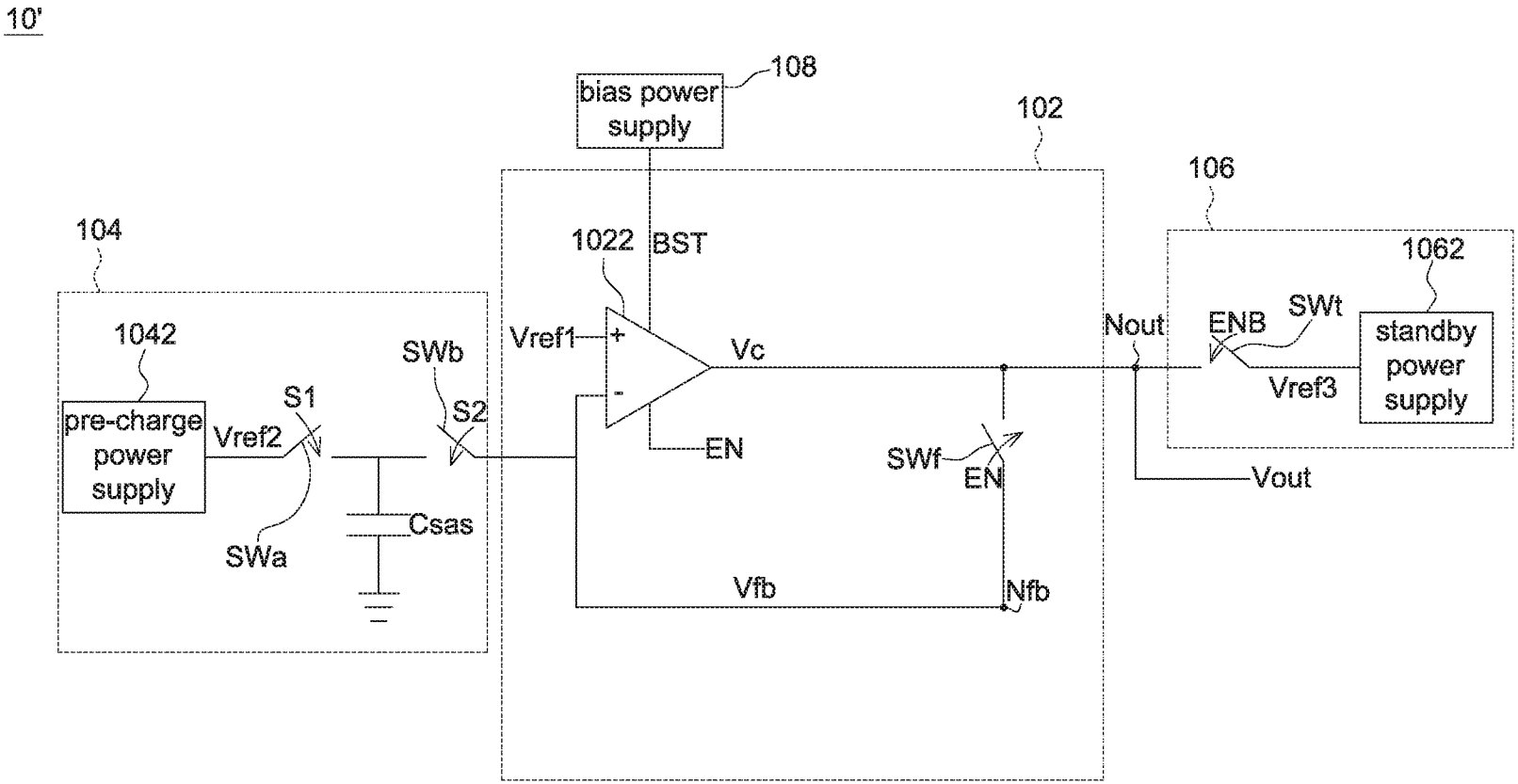
FIG. 1B illustrates a circuit diagram of a LDO regulating device according to another embodiment of the present disclosure.

FIG. 1B illustrates a circuit diagram of a LDO regulating device 10' according to another embodiment of the present disclosure. Compared to the LDO regulating device 10, the LDO regulating device 10' does not include the feedback circuit 1024, so that one terminal of the output transistor M1 is coupled directly to an input (e.g., negative (–) input terminal) of the comparing circuit 1022 through the feedback switch SWf (optionally). Understandably, the circuit configuration of the LDO regulating device 10' which does not include the feedback circuit 1024, is appropriate to be used in embodiments of the present invention. In such instance, the feedback node Nfb is defined at the junction where the output transistor M1 is connected to the input of the comparing circuit 1022.

Figure 2A:
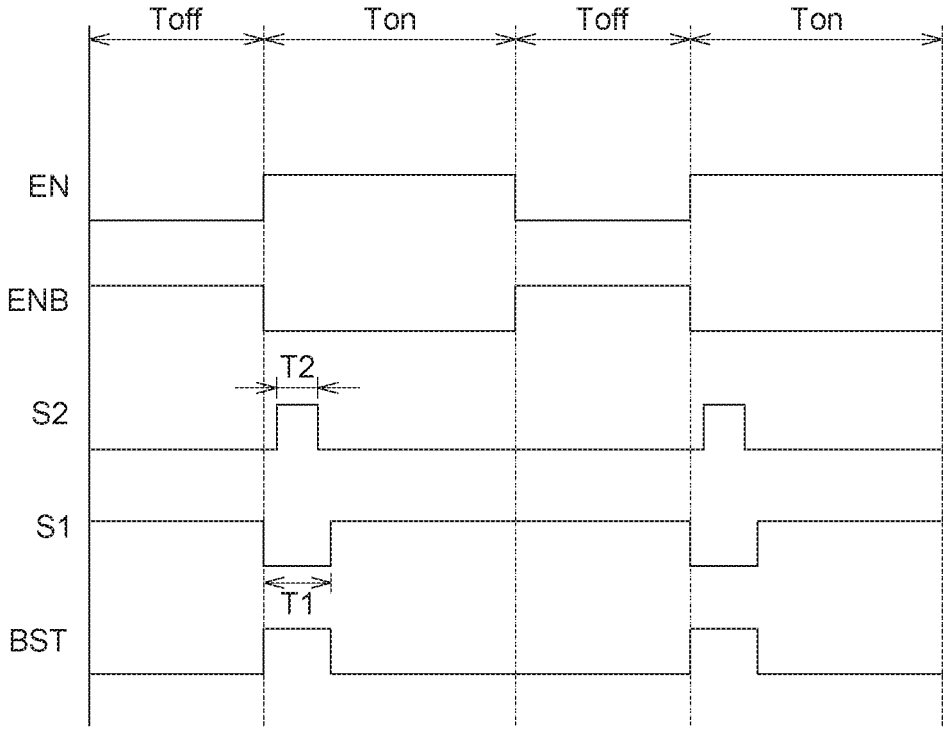
FIG. 2A shows waveforms of signals related to the LDO regulating device.

FIG. 2A shows waveforms of signals related to the LDO regulating device 10.

During the period of time Toff, the switching signal EN is disabled (e.g., with low signal level) to turn off the regulator 102, and the inversed switching signal ENB is enabled (e.g., with high signal level) to make the standby power supply 1062 power the output node Nout. Further, the sampling signal S1 is enabled to turn on the sampling switch SWa, allowing the second reference voltage Vref2 to charge the pre-charge capacitor Csas, and the sharing signal S2 is disabled to turn off the sharing switch SWb, so as to electrically disconnect the pre-charge capacitor Csas from the feedback node Nfb.

During the period of time Ton, the switching signal EN is enabled to turn on the regulator 102, and the inversed switching signal ENB is disabled to electrically disconnect the standby power supply 1062 from the output node Nout. Further, in the beginning of the time period Ton, the sampling signal S1 is disabled to turn off the sampling switch SWa for a first period of time T1, such that the second reference voltage Vref2 electrically disconnects from the pre-charge capacitor Csas. During a second period of time T2 within the first period of time T1, the sharing switch SWb is turned on in response to the enabled sharing signal S2, such that the pre-charge capacitor Csas electrically connects the feedback node Nfb for charge sharing.

In an embodiment, to ensure that there is no extra charges (e.g., charges from the pre-charge power supply 1042) flow into the feedback node Nfb during the charge sharing and to make the feedback voltage Vfb predictable, the second period of time T2 is shorter than the first period of time T1, i.e., the raising edge of the sharing signal S2 lags the falling edge of the sampling signal S1, and the falling edge of the sharing signal S2 leads the raising edge of the sampling signal S1, as shown in FIG. 2A.

After the charge sharing is finished, the sampling switch SWa and the sharing switch SWb will turn back to be turned-on and turned-off, respectively, until the next time that the LDO regulating device 10 switches from the OFF state to the ON state again. As shown in FIG. 2A, for each time the regulator 102 switches from the OFF state to the ON state, the pre-charger 104 may share its charges with the feedback node Nfb for only one time, to properly setup the feedback voltage Vfb in the initial stage of the ON state of the regulator 102.

In the example of FIG. 2A, the bias signal BST is an inversed version of the sampling signal S1. That is, the bias power supply 108 may increase the bias current of the comparing circuit 1022 during the first period of time T1, to further accelerate the startup speed of the control node Nc.

Figure 2B:
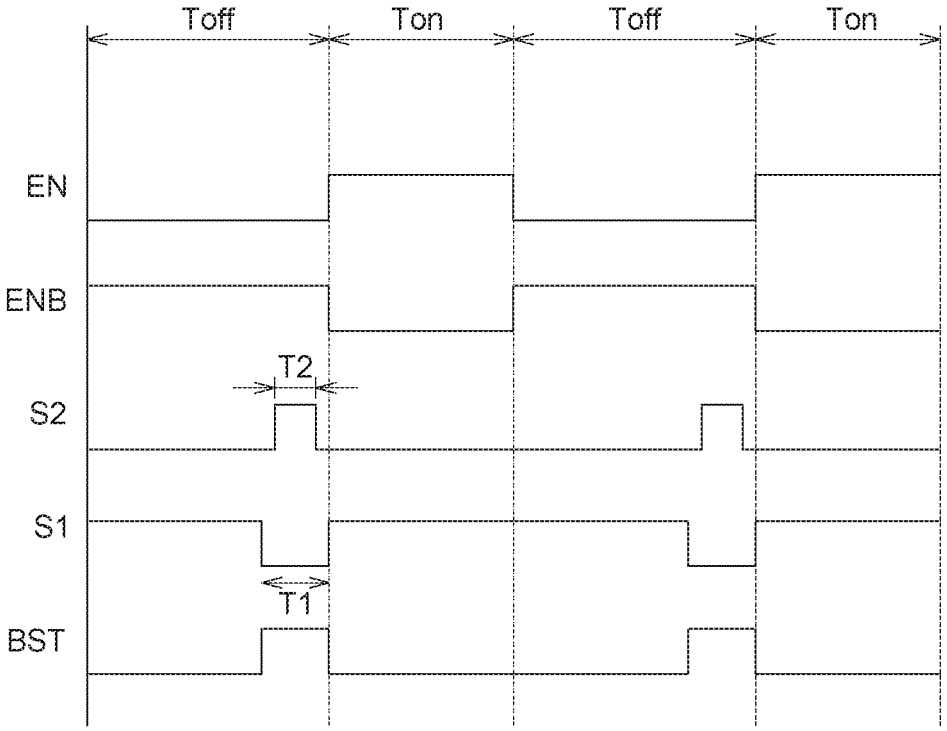
FIG. 2B shows another example of waveforms of signals related to the LDO regulating device.

FIG. 2B shows waveforms of signals related to the LDO regulating device 10. Compared to the embodiment shown in FIG. 2A, in this embodiment the pre-charger 104 is electrically connected to the feedback node Nfb to pre-charge the feedback node Nfb before the regulator 102 enters in the ON state (i.e., the regulator 102 is in the OFF state). As shown in FIG. 2B, both the first period of time T1 that the sampling signal S1 is disabled and the second period of time T2 that the sharing signal S2 is enabled are located in the period of time (i.e., the period of time Toff) that the switching signal EN is disabled and the inversed switching signal ENB is enabled. It is understood that similar to the waveform operation shown in FIG. 2A, the waveform operation shown in FIG. 2B is applicable for various embodiments of the present disclosure.

Figure 3A:
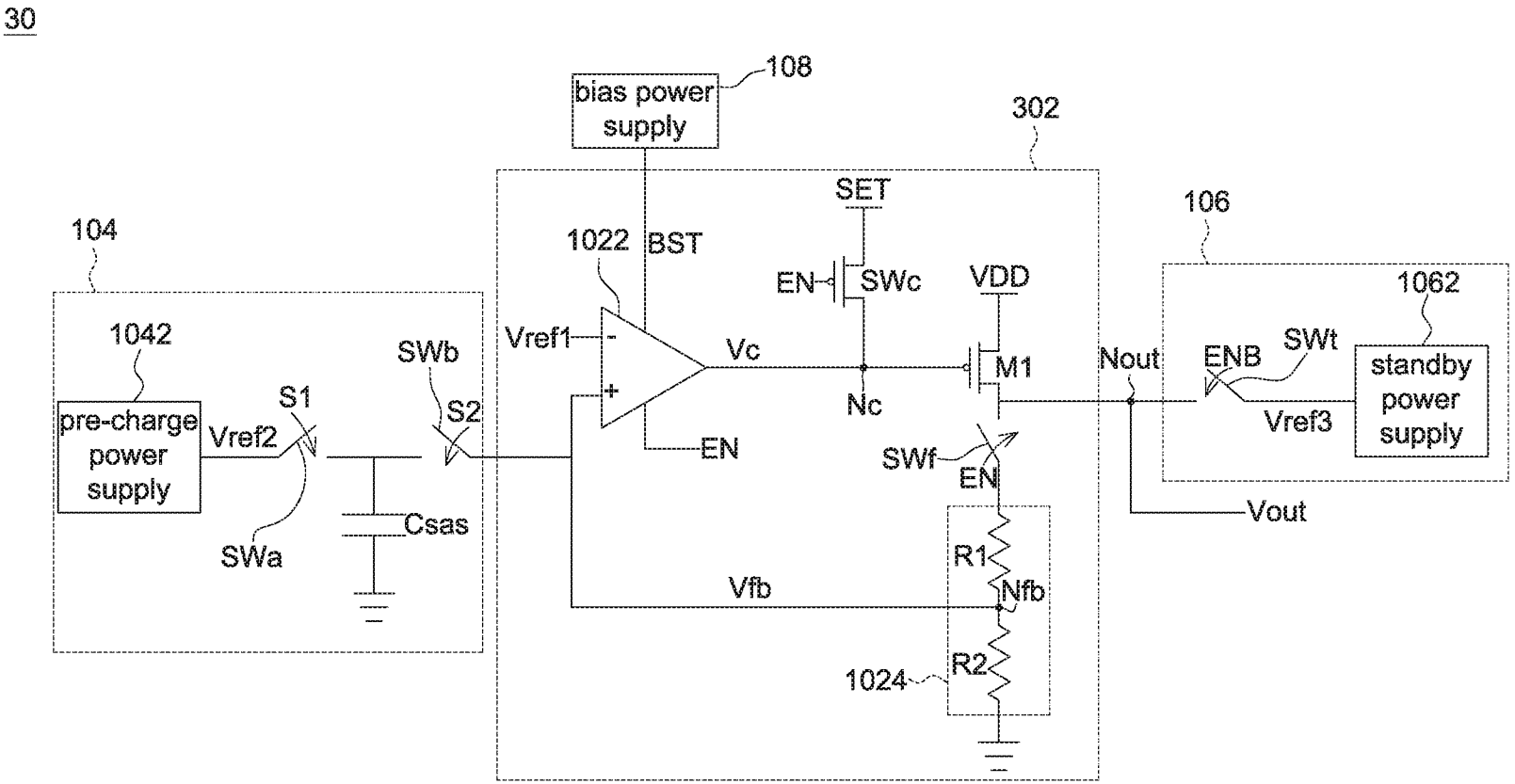
FIG. 3A illustrates a circuit diagram of a LDO regulating device according to another embodiment of the present disclosure.

FIG. 3A illustrates a circuit diagram of a LDO regulating device 30 according to an embodiment of the present disclosure. The signal operation of the LDO regulating device 30 is the same as that shown in FIG. 2A. In this example, the output transistor M1 and the control switch SWc of the regulator 302 of the LDO regulating device 30 are implemented as P-type transistors, such as PMOS. Moreover, in this embodiment, the setting voltage SET coupled to the control switch SWc has a high voltage level, e.g., supply voltage, and the control switch SWc is controlled by the switching signal EN.

Figure 3B:
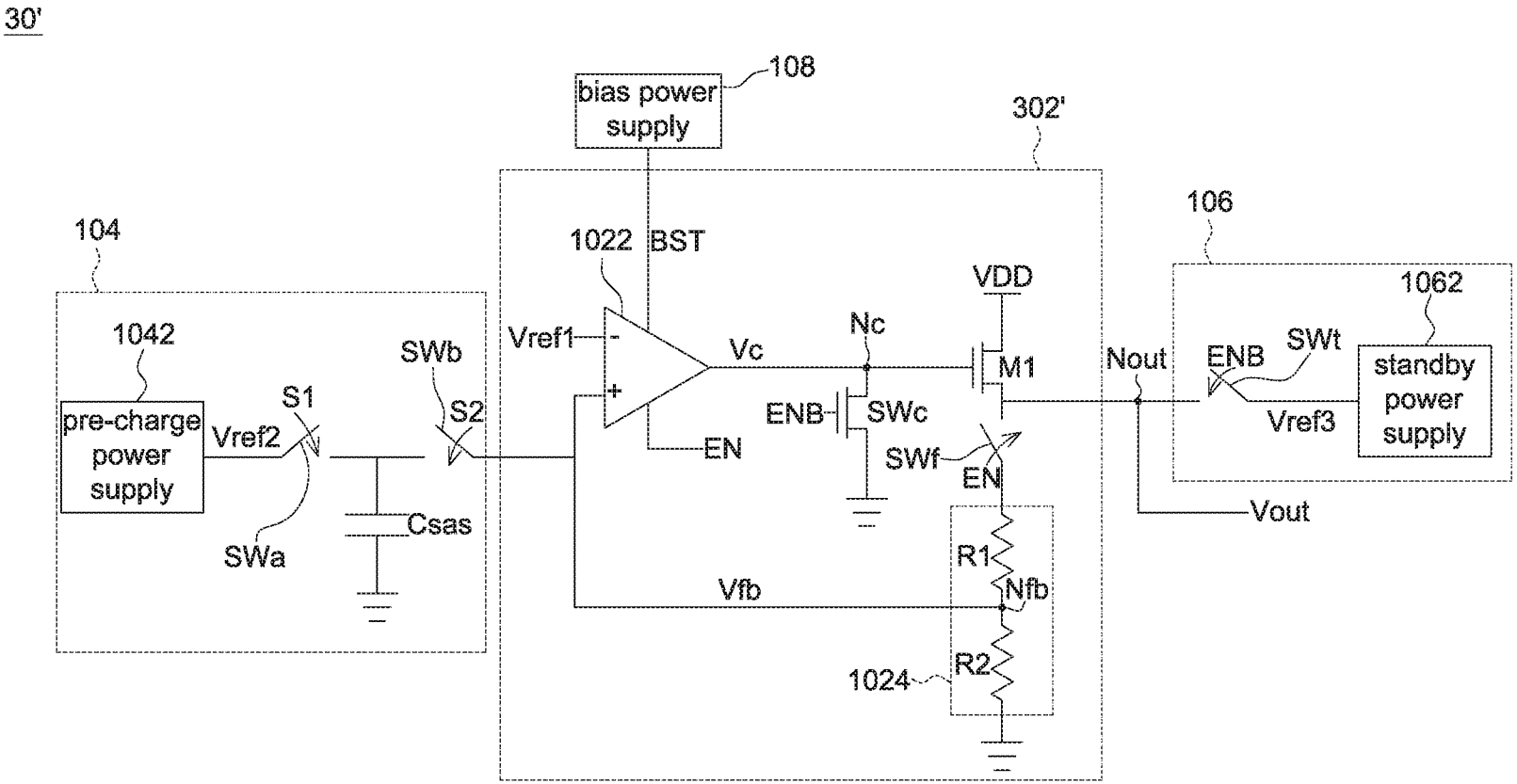
FIG. 3B illustrates a circuit diagram of a LDO regulating device according to another embodiment of the present disclosure.

FIG. 3B illustrates a circuit diagram of a LDO regulating device 30' according to another embodiment of the present disclosure. The signal operation of the LDO regulating device 30' is the same as that shown in FIG. 2A. In this example, the output transistor M1 and the control switch SWc of the regulator 302 of the LDO regulating device 30 are implemented as N-type transistors, such as NMOS. Moreover, in this embodiment, the setting voltage SET coupled to the control switch SWc has a low voltage level, e.g., ground, and the control switch SWc is controlled by the inversed switching signal ENB.

Figure 4A:
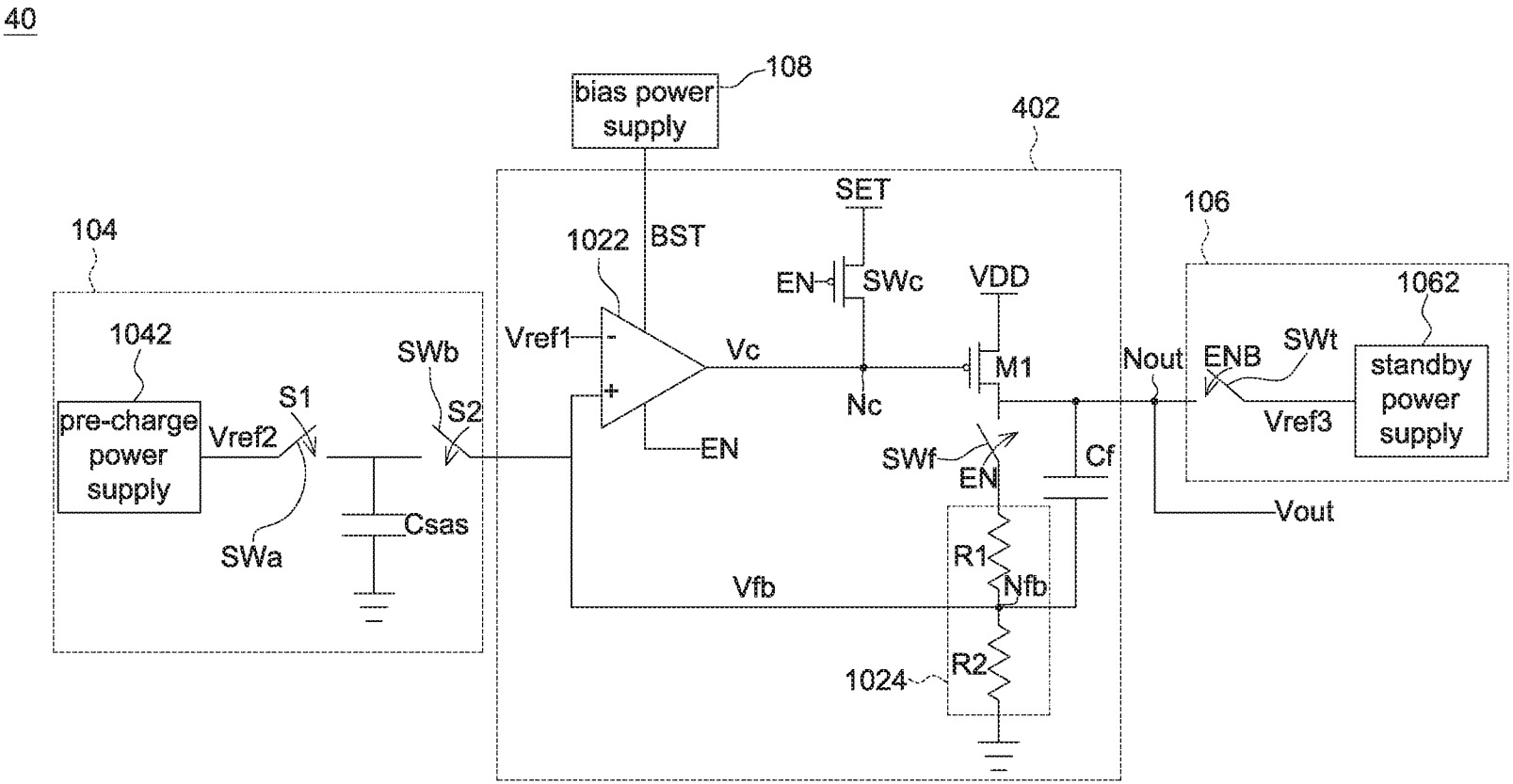
FIG. 4A illustrates a circuit diagram of a LDO regulating device according to yet another embodiment of the present disclosure.

FIG. 4A illustrates a circuit diagram of a LDO regulating device 40 according to yet another embodiment of the present disclosure. The signal operation of the LDO regulating device 40 is the same as that shown in FIG. 2A. The main difference between the LDO regulating device 40 and the LDO regulating device 30 shown in FIG. 3A is that the regulator 402 of the LDO regulating device 40 further includes a feedback capacitor Cf. As shown in FIG. 4A, the feedback capacitor Cf couples between the output node Nout and the feedback node Nfb. During the period of time that the pre-charge capacitor Csas electrically connects to the feedback node Nfb (e.g., the second period of time T2 shown in FIG. 2A), the pre-charge capacitor Csas shares charges with the feedback node Nfb, so the magnitude of the feedback voltage Vfb can be determined.

Because the capacitance loading on the output node Nout is quite large in most of applications, the feedback voltage Vfb after charge sharing can be estimated as:

$$Vfb = Vref2 \times \frac{C_Csas}{C_Csas + C_Cf + C_Cpar}$$

where C_Csas is the capacitance of the pre-charge capacitor Csas, C_Cf is the capacitance of the feedback capacitor Cf, and C_Cpar is the capacitance of the parasitic capacitor at the feedback node Nfb.

If C_Cpar is much smaller than C_Csas and C_Cf, the feedback voltage Vfb can be simplified as:

$$Vfb = Vref2 \times \frac{C_Csas}{C_Csas + C_Cf}$$

In this manner, as the pre-charge capacitor Csas and the feedback capacitor Cf are properly selected, the feedback voltage Vfb can be set to a required level after charge sharing.

Figure 4B:
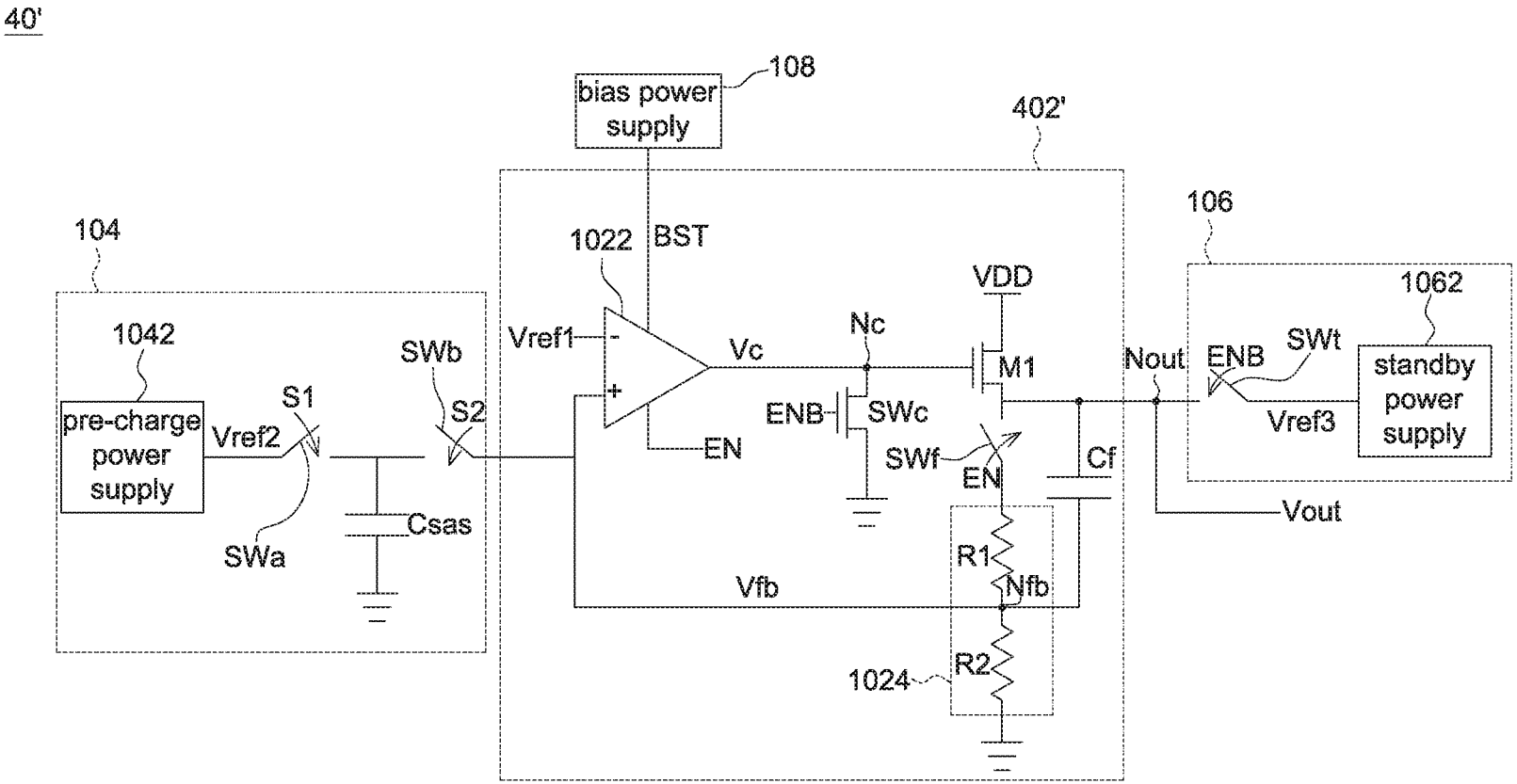
FIG. 4B illustrates a circuit diagram of a LDO regulating device according to yet another embodiment of the present disclosure.

FIG. 4B illustrates a circuit diagram of a LDO regulating device 40' according to yet another embodiment of the present disclosure. The signal operation of the LDO regulating device 50 is the same as that shown in FIG. 2A. The main difference between the LDO regulating device 40' and the LDO regulating device 40 shown in FIG. 4A is that the output transistor M1 and the control switch SWc of the regulator 402' of the LDO regulating device 40' are implemented as N-type transistors, such as NMOS. Moreover, in this embodiment, the setting voltage SET coupled to the control switch SWc has a low voltage level, e.g., ground, and the control switch SWc is controlled by the inversed switching signal ENB.

Figure 5A:
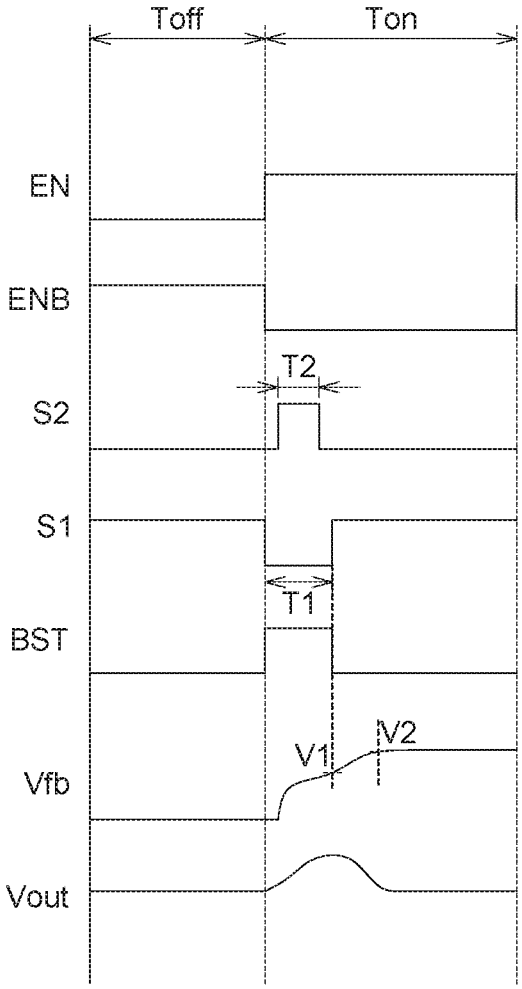
FIG. 5A shows an example of waveforms of signals related to the LDO regulating device.

FIG. 5A shows an example of waveforms of signals related to the LDO regulating device 40. The switching signal EN, the sampling signal S1 and the sharing signal S2 have waveforms the same as that shown in FIG. 2A. In this example, the ratio of the pre-charge capacitor Csas and the feedback capacitor Cf are designed to meet the following equation:

$$\frac{Vref2 \times Csas}{Csas + Cf} < Vref1 \quad \text{(eq1)}$$

When (eq1) is satisfied, i.e., the feedback voltage Vfb is less than the first reference voltage Vref1, the output voltage Vout will present overshoot behaver in the beginning of the period of time Ton.

As shown in FIG. 5A, in the beginning of the first period of time T1 (e.g., the falling edge of the sampling signal S1), the sampling signal S1 is disabled to turned off the sampling switch SWa, such that the second reference voltage Vref2 electrically disconnects from the pre-charge capacitor Csas and the output voltage Vout is temperately higher than the final stable value (overshoot).

In the beginning of the second period of time T2 (e.g., the raising edge of the sharing signal S2), the sharing switch SWb is turned on in response to the enabled sharing signal S2, such that the pre-charge capacitor Csas electrically connects the feedback node Nfb for charge sharing. Meanwhile, the feedback voltage Vfb increases to a level smaller than the first reference voltage Vref1, thereby forcing the comparing circuit 1022 to increase the overdrive of the output transistor M1. In the end of the first period of time T1 (e.g., the raising edge of the sampling signal S1), the feedback voltage Vfb has been pre-charged to a predetermined voltage level V1 that is very close to the stable state voltage level V2. Therefore, the time interval required to charge the feedback voltage Vfb from a low voltage level (0V) to the stable state voltage V2 is reduced. In contrast, if without the pre-charger 104, the time interval required to charge the feedback voltage Vfb from a low voltage level (0V) to the stable state voltage V2 only depends on the charging through the feedback path included in the regulator 102, i.e., charging through the resistor-capacitor path. In such situation, compared to that the design that employing the pre-charger 104, it takes more time for charging.

Figure 5B:
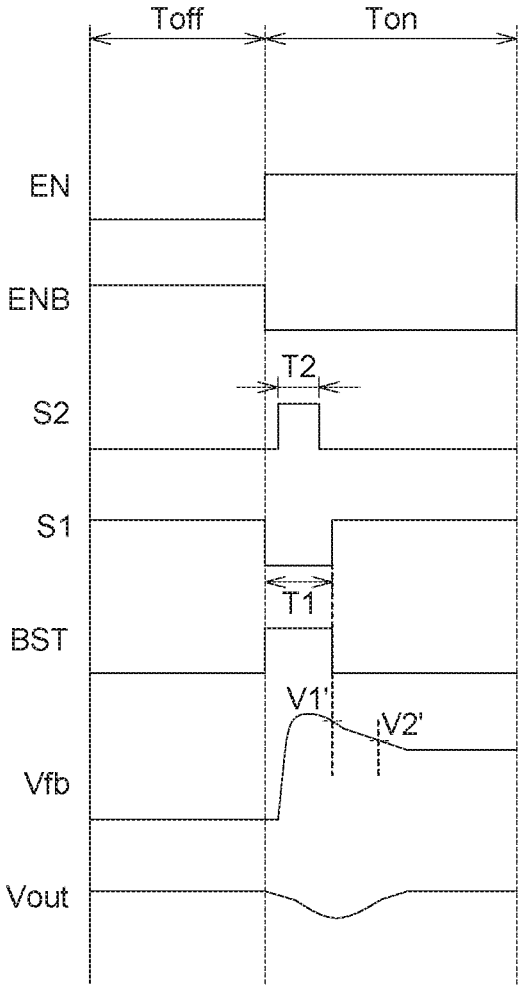
FIG. 5B shows another example of waveforms of signals related to the LDO regulating device.

FIG. 5B shows another example of waveforms of signals related to the LDO regulating device 40. The main difference between embodiments of FIGS. 5A and 5B is that in this example, the ratio of the pre-charge capacitor Csas and the feedback capacitor Cf are designed to meet the following equation:

$$\frac{Vref2 \times Csas}{Csas + Cf} > Vref1 \quad \text{(eq2)}$$

When (eq2) is satisfied, i.e., the feedback voltage Vfb is greater than the first reference voltage Vref1, the output voltage Vout will present undershoot behaver in the beginning of the period of time Ton.

As shown in FIG. 5B, in the beginning of the first period of time T1, the sampling signal S1 is disabled to turn off the sampling switch SWa, such that the second reference voltage Vref2 electrically disconnects from the pre-charge capacitor Csas and the output voltage Vout is temperately lower than the final stable value (undershoot).

In the beginning of the second period of time T2, the sharing switch SWb is turned on in response to the enabled sharing signal S2, such that the pre-charge capacitor Csas electrically connects the feedback node Nfb for charge sharing. Meanwhile, the feedback voltage Vfb boosts to a level larger than the first reference voltage Vref1, thereby forcing the comparing circuit 1022 to decrease the overdrive of the output transistor M1. In the end of the first period of time T1, the feedback voltage Vfb has been pre-charged to a predetermined voltage level V1' that is very close to the stable state voltage level V2'. Therefore, the time interval required to charge the feedback voltage Vfb from a low voltage level (0V) to the stable state voltage V2' is reduced.

In circuit design, considering that when the regulator 102 is power on, the periphery circuit loads may share the current of the regulator 102, causing the output waveform to drop rapidly. Therefore, assuming that the capacitors Csas and Cf have been set with predetermined values, the second reference voltage Vref2 is usually designed as being larger than the first reference voltage Vref1, so as to overshoot the output transistor M1 to compensate the current. In this manner, the output waveform can reach to the stable state voltage more quickly.

Figure 6:
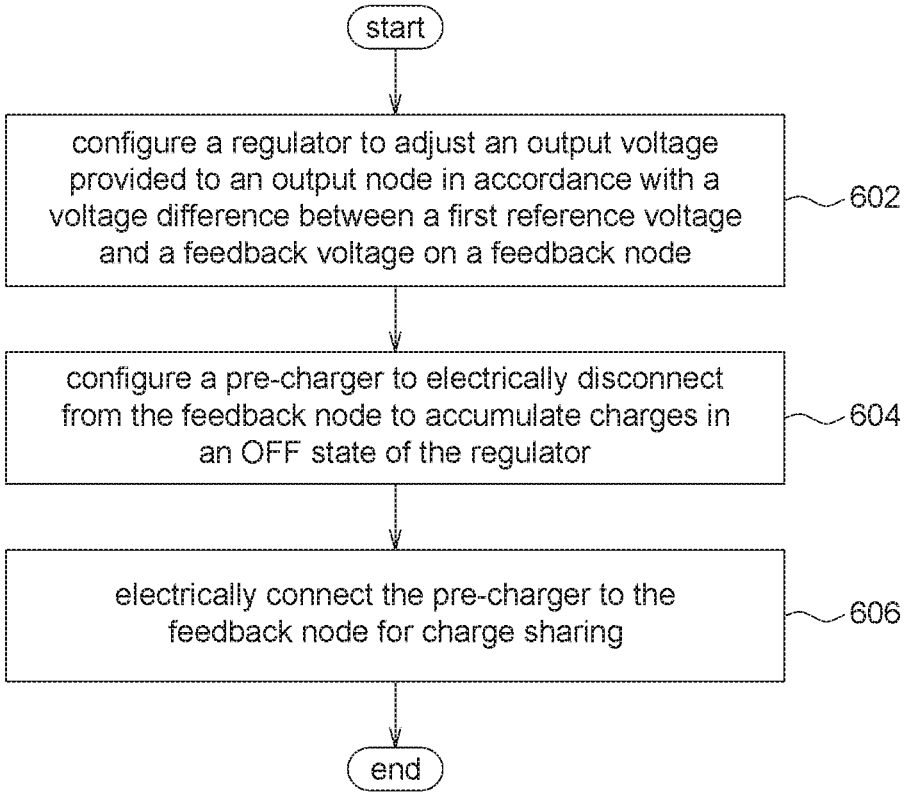
FIG. 6 shows a flowchart of an operating method for a LDO regulating device according to an embodiment of the present invention.

FIG. 6 shows a flowchart of an operating method for a LDO regulating device according to an embodiment of the present invention. For explanatory purposes, the operating method is described herein with reference to the LDO regulating device 10 shown in FIG. 1A. However, the present invention is not limited thereto. The operating method can be adapted to each LDO regulating device of the abovementioned embodiments.

At step 602, the regulator 102 is configured to adjust the output voltage Vout provided to the output node Nout in accordance with the voltage difference between the first reference voltage Vref1 and the feedback voltage Vfb on the feedback node Nfb.

At step 604, the pre-charger 104 is configured to electrically disconnect from the feedback node Nfb and accumulate charges by itself when the regulator 102 is in the OFF state.

At step 606, the pre-charger 104 is configured to electrically connect to the feedback node Nfb for charge sharing with the feedback node Nfb.

With the proposed method, the feedback voltage Vout can be increased to a suitable level in a very short time, so the required startup time of the LDO regulating device can be effectively shortened.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A low dropout (LDO) regulating device, comprising:

a regulator, configured to adjust an output voltage provided to an output node in accordance with a voltage difference between a first reference voltage and a feedback voltage on a feedback node, wherein the feedback node is coupled to the output node, and the regulator comprises:

a comparing circuit, configured to receive the first reference voltage and the feedback voltage, and generate a control voltage on a control node in accordance with the voltage difference between the first reference voltage and the feedback voltage; and an output transistor including a control terminal coupling to the control node, a first terminal coupling to a supply voltage and a second terminal coupling to the output node, wherein the output transistor responds to the control voltage to generate the output voltage at the second terminal; and a pre-charger, electrically connected to the regulator, the pre-charger being electrically connected to the feedback node for charge sharing, wherein the pre-charger comprises:

a pre-charge capacitor;

a pre-charge power supply, configured to provide a second reference voltage; and a sampling switch, coupled between the pre-charge capacitor and the pre-charge power supply, allowing the pre-charge power supply to charge the pre-charge capacitor.

2. The LDO regulating device according to claim 1, wherein the regulator further comprises:

a control switch coupling between a setting voltage and the control node, wherein when the regulator is in an ON state, the control switch is turned off, causing the setting voltage to be electrically disconnected from the control node, and when the regulator is in an OFF state, the control switch is turned on, causing the setting voltage to be passed to the control node to turn off the output transistor.

3. The LDO regulating device according to claim 1, wherein the regulator further comprises:

a feedback circuit, coupled between the output node and the comparing circuit, configured to provide a voltage division path to form the feedback node, and to provide the feedback voltage on the feedback node to the comparing circuit; and a feedback switch disposed between the feedback circuit and the output node, wherein when the regulator is in an ON state, the feedback switch couples the output node to the feedback circuit, when the regulator is in an OFF state, the feedback switch electrically disconnects the output node from the feedback circuit.

4. The LDO regulating device according to claim 1, wherein the pre-charger further comprises:

a sharing switch, coupled between the pre-charge capacitor and the feedback node, allowing the pre-charge capacitor to share charges with the feedback node.

5. The LDO regulating device according to claim 4, wherein when the regulator is in an OFF state, the sampling switch couples the pre-charge capacitor to the pre-charge power supply, and the sharing switch electrically disconnects the pre-charge capacitor from the feedback node; and when the regulator is in an ON state, the sampling switch electrically disconnects the pre-charge capacitor from the pre-charge power supply in a first period of time, and the sharing switch electrically connects the pre-charge capacitor to the feedback node in a second period of time within the first period of time.

6. The LDO regulating device according to claim 1, further comprising:

a bias power supply, coupled to the comparing circuit, configured to provide a bias signal to the comparing circuit to increase a bias current of the comparing circuit when the regulator is in an ON state.

7. The LDO regulating device according to claim 1, further comprising:

a feedback capacitor, coupled between the output node and the feedback node, configured to determine a predetermined value of the feedback voltage as the charge sharing between the feedback capacitor and the pre-charge capacitor is finished.

8. The LDO regulating device according to claim 1, further comprising:

a maintain circuit, configured to power the output node when the regulator is in an OFF state, comprising:

a standby power supply, configured to provide a third reference voltage; and a standby switch, disposed between the standby power supply and the output node, allowing the standby power supply to power the output node with the third reference voltage as the regulator is in the OFF state.

9. The LDO regulating device according to claim 1, wherein the pre-charger includes a second reference voltage greater than the first reference voltage.

10. An operating method of a low dropout (LDO) regulating device, comprising:

configuring a regulator to adjust an output voltage provided to an output node in accordance with a voltage difference between a first reference voltage and a feedback voltage on a feedback node;

configuring a pre-charger to electrically disconnect from the feedback node to accumulate charges in an OFF state of the regulator; and electrically connecting the pre-charger to the feedback node for charge sharing, wherein said step of configuring the regulator further comprises:

configuring a comparing circuit to receive the first reference voltage and the feedback voltage, and generate a control voltage on a control node in accordance with the voltage difference between the first reference voltage and the feedback voltage;

configuring an output transistor including a control terminal coupling to the control node, a first terminal coupling to a supply voltage and a second terminal coupling to the output node, wherein when the regulator is in an ON state, transferring the supply voltage to the output node via the output transistor; and configuring a feedback circuit coupled between the output node and the comparing circuit, to provide a voltage division path to form the feedback node, and to provide the feedback voltage on the feedback node to the comparing circuit, wherein said step of configuring the pre-charger further comprises:

configuring a pre-charge power supply to provide a second reference voltage;

configuring a pre-charge capacitor selectively couples to the pre-charge power supply;

charging the pre-charge capacitor with the second reference voltage when the regulator is in the OFF state.

11. The operating method according to claim 10, wherein said step of configuring the regulator further comprises:

configuring a control switch coupled between a setting voltage and the control node, wherein when the regulator is in the ON state, the control switch is turned off, causing the setting voltage to be electrically disconnected from the control node, and when the regulator is in the OFF state, the control switch is turned on, causing the setting voltage to be passed to the control node to turn off the output transistor.

12. The operating method according to claim 10, wherein said step of configuring the regulator further comprises:

configuring a feedback switch disposed between the feedback circuit and the output node, wherein when the regulator is in the ON state, the feedback switch couples the output node to the feedback circuit, when the regulator is in the OFF state, the feedback switch electrically disconnects the output node from the feedback circuit.

13. The operating method according to claim 10, wherein said step of configuring the pre-charger further comprises:

making the pre-charge capacitor share charges with the feedback node when the regulator is in the OFF state.

14. The operating method according to claim 13, further comprising:

when the regulator is in the OFF state, coupling the pre-charge capacitor to the pre-charge power supply, and electrically disconnecting the pre-charge capacitor from the feedback node; and when the regulator is in the ON state, electrically disconnecting the pre-charge capacitor from the pre-charge power supply in a first period of time, and electrically connecting the pre-charge capacitor to the feedback node in a second period of time within the first period of time.

15. The operating method according to claim 10, further comprising:

configuring a bias power supply, to provide a bias signal to the comparing circuit to increase a bias current of the comparing circuit when the regulator is in the ON state.

16. The operating method according to claim 10, further comprising:

configuring a feedback capacitor coupled between the output node and the feedback node, to determine a predetermined value of the feedback voltage as the charge sharing between the feedback capacitor and the pre-charge capacitor is finished.

17. The operating method according to claim 10, further comprising:

configuring a maintain circuit, to power the output node when the regulator is in the OFF state.

18. The operating method according to claim 10, wherein the pre-charger includes a second reference voltage greater than the first reference voltage.

* * * * *